US007441969B2

(12) United States Patent
Choh et al.

(10) Patent No.: US 7,441,969 B2
(45) Date of Patent: Oct. 28, 2008

(54) PORTABLE PRINTING APPARATUS HAVING CYLINDRICAL PAPER PATH BETWEEN INNER AND OUTER CASES

(75) Inventors: Heui-keun Choh, Seongnam-si (KR); Gee-young Sung, Daegu-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 240 days.

(21) Appl. No.: 11/245,139

(22) Filed: Oct. 7, 2005

(65) Prior Publication Data

US 2006/0078365 A1 Apr. 13, 2006

(30) Foreign Application Priority Data

Oct. 9, 2004 (KR) ..... 10-2004-0080723

(51) Int. Cl.
*B41J 3/36* (2006.01)
*B41J 29/00* (2006.01)

(52) U.S. Cl. ..... 400/88; 400/693; 347/109; 347/104

(58) Field of Classification Search ..... 400/88, 400/693, 691, 692; 347/222, 109, 38, 108, 347/104; *B41J 3/36*
See application file for complete search history.

(56) References Cited

U.S. PATENT DOCUMENTS 725,856 A * 4/1903 Loyd ..... 30/104
3,699,249 A * 10/1972 Crane et al. ..... 358/424
3,864,696 A * 2/1975 Fischbeck ..... 347/38
4,591,281 A * 5/1986 Howard et al. ..... 347/104
5,535,010 A 7/1996 Izumi et al.
2002/0044306 A1 4/2002 Mercer

FOREIGN PATENT DOCUMENTS

DE 203 18 595 U1 6/2004

* cited by examiner

*Primary Examiner*—Leslie J Evanisko
(74) *Attorney, Agent, or Firm*—Lee & Morse, P.C.

(57) ABSTRACT

A printing apparatus comprising an outer case having a cylindrical inner surface, an inner case inside the outer case and having a cylindrical outer surface facing and spaced by a predetermined distance from the cylindrical inner surface of the outer case; a paper path formed between the inner surface of the outer case and the outer surface of the inner case; a paper feed unit feeding a sheet of paper along the paper path; a printing unit rotatably mounted inside and about a central axis of the inner case; and a rotating unit rotating the printing unit. The length and width of the printing apparatus is less than the length and width of the sheet of paper, thereby providing true compactness and portability without sacrificing print quality. Continuous rotating printing unit provides significant increase in print speed without sacrificing print quality.

28 Claims, 7 Drawing Sheets

PORTABLE PRINTING APPARATUS HAVING CYLINDRICAL PAPER PATH BETWEEN INNER AND OUTER CASES

BACKGROUND OF THE INVENTION

1. Field of the Invention

The present invention relates to a printing apparatus and, more particularly, to a highly compact and portable printing apparatus capable of high print speeds.

2. Description of the Related Art

Printing apparatuses print on a sheet of paper an image corresponding to image information stored in a computer or an external storage medium. Based on different printing methods, printing apparatuses are classified into various types of printers such as an inkjet, electrophotographic, piezo-electric and thermal.

FIG. 1 is a perspective view of a conventional inkjet printing apparatus, and FIG. 2 is a perspective view illustrating a print operation of the conventional inkjet printing apparatus shown in FIG. 1.

Referring to FIGS. 1 and 2, a conventional inkjet printing apparatus 10 includes a body 11 in which an ink cartridge 12, i.e., a printing unit, is installed. A sheet of paper P is loaded into the body 11, and then fed in a direction marked by arrow X. The ink cartridge 12 has a print head (not shown) facing the sheet of paper P, and an image is printed on a surface of the sheet of paper P using ink ejected from the print head.

The conventional inkjet printing apparatus effects printing of an image on the sheet of paper P by incrementally advancing the sheet of paper in a direction X between linear back and forth reciprocating print operation of the print head in directions $Y_1$ and $Y_2$. The ink cartridge 12 ejects ink while moving linearly ($Y_1$ or $Y_2$) during which time the sheet of paper P is not moved. At the end of a linear movement ($Y_1$ or $Y_2$) of the ink cartridge 12, the sheet of paper P is incrementally advanced by a paper feed unit (not shown) in the X direction, and at the end of the incremental advancement of the sheet of paper P, the ink cartridge 12 linearly moves in an opposite direction ($Y_2$ or $Y_1$, respectively) while ink is ejected from the print head, thereby printing an image on the sheet of paper P.

The conventional inkjet printing apparatus 10 prints an image via the ink cartridge 12 reciprocating in the direction marked by arrows $Y_1$ and $Y_2$, perpendicular to the paper feed direction marked by arrow X. Since the ink cartridge 12 repeatedly moves and stops to change its direction of motion in a reciprocating manner, printing continuity is interrupted and print speed is adversely affected.

As more portable electronic apparatuses such as notebook computers, personal digital assemblies, and mobile phones, are put to use in ever growing numbers, the demand for portable printing apparatuses that can be connected to portable electronic apparatuses to output printed matter has increased dramatically. Accordingly, there is a great demand and need for printing apparatuses that are compact and portable, yet provide high print speeds without reduction in print quality. Due to the operating mechanism of conventional inkjet printing apparatus deploying linearly reciprocating cartridge 12 movement across a width of a sheet of paper P, the width of the conventional printing apparatus 10 cannot be made to be less than the width of a conventional sheet of paper P (usually 8½×11 inches or A4 size paper), and thus there is a limitation in the miniaturization, compactness and portability thereof, i.e., there is a need for a compact, portable printer that has a physical dimension less than 8½ inches at its largest dimension.

SUMMARY OF THE INVENTION

The present invention provides a portable printing apparatus having dimensions, any one of which is less than that any length or width of a conventional sheet of paper, while exhibiting high print speed by use of a rotating print head.

According to an aspect of the present invention, there is provided a printing apparatus comprising an outer case having a cylindrical inner surface, an inner case installed inside the outer case and having a cylindrical outer surface facing and spaced by a predetermined distance from the cylindrical inner surface of the outer case, a paper path formed between the cylindrical inner surface of the outer case and the cylindrical outer surface of the inner case, a paper feed unit for feeding a sheet of paper along the paper path, a printing unit rotatably mounted about a central axis of the inner case, and a rotating unit operatively associated with the printing unit to rotate the printing unit about the central axis of the inner case. The length of each of the outer case and the inner case may be less than the length of the sheet of paper. The diameter of the cylindrical inner surface of the outer case may be less than the width of the sheet of paper. The inner case may have a slot having a predetermined width formed therein along a path of the printing unit.

The printing unit may include at least one ink cartridge rotatably mounted on the rotating unit and having a print head that ejects ink onto the sheet of paper to print an image. The at least one ink cartridge may include a black ink cartridge and several color ink cartridges. The printing unit may include a head support unit rotatably mounted on the rotating unit and have a thermal head that prints an image on the sheet of paper.

The paper feed unit may include a plurality of paper feed rollers rotatably mounted on the inner case, and a roller driving motor operatively engaged with each paper feed roller to rotate each paper feed roller. The inner case may have a plurality of through-holes through which a surface of each of the plurality of paper feed rollers can contact the sheet of paper passing along the paper path. The paper feed unit may further include a plurality of idle rollers mounted on the inner surface of the outer case to respectively correspond to the plurality of paper feed rollers. The inner surface of the outer case may have a plurality of grooves into which the plurality of paper feed rollers are respectively inserted to a predetermined depth.

A paper contacting unit may be further provided for contacting the sheet of paper onto the outer surface of the inner case. The paper contacting unit may include a plurality of leaf springs mounted on the inner surface of the outer case.

The rotating unit may include a driving motor for rotating the printing unit, and a support member on the inner case to support the driving motor. A base supporting the outer case and the inner case may also be provided.

The paper path of the printing apparatus of the present invention is non-planar, and is preferably cylindrical.

In an alternative embodiment of the present invention, the outer case may be opened or closed. To effect this, the outer case may comprise two portions, each portion having first ends hinge-connected to each other and second ends on which an opening unit is disposed. The opening unit may include a hook disposed on the second end of one of the two portions of the outer case, and a groove formed in the second end of the other one of the two portions in order to allow the hook to engage and be held in the groove.

A protective case surrounding and protecting the outer case and the inner case may also be provided. The protective case may have a shape corresponding to the outer case, and may be opened and closed. The protective case may be divided into two portions which have first ends hinge-connected to the outer case and second ends on which an opening unit is disposed. The opening unit may include a hook disposed on the second end of one of the two portions of the protective case, and a groove formed in the second end of the other one of the two portions in order to allow the hook to engage and be held in the groove. The protective case may also have a handle.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
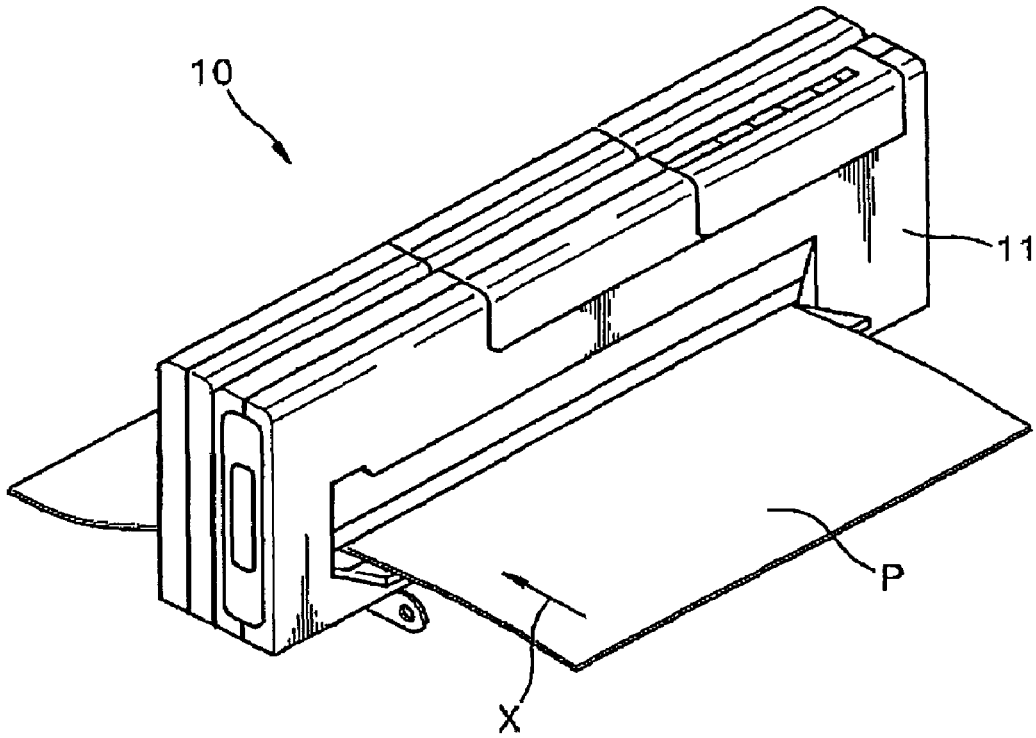
FIG. 1 (PRIOR ART)
FIG. 1 is a perspective view of a conventional printing apparatus.
Figure 2:
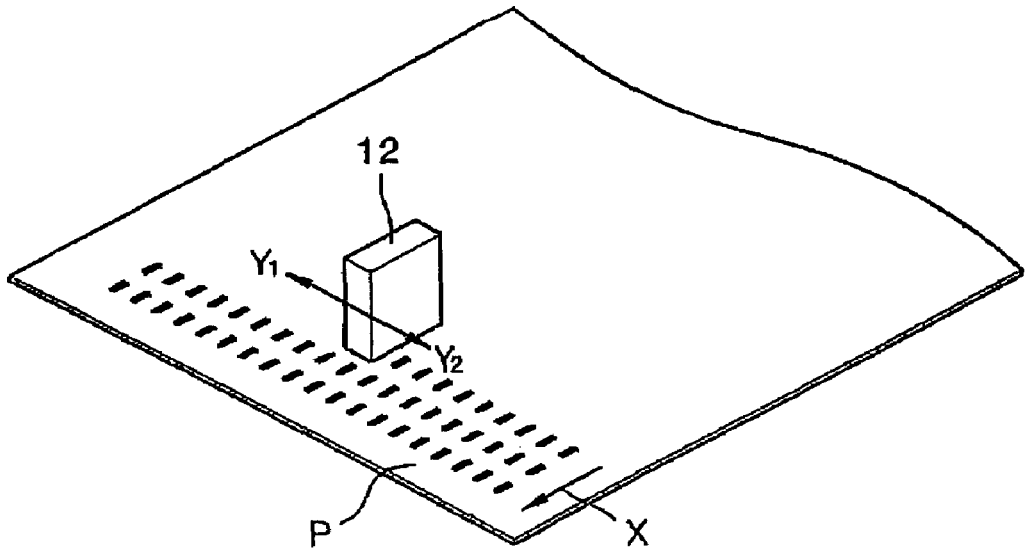
FIG. 2 (PRIOR ART)
FIG. 2 is a perspective view relative to a print medium such as a sheet of paper illustrating a print operation of the conventional printing apparatus shown in FIG. 1.

This application claims the priority of Korean Patent Application No. 10-2004-0080723, filed on Oct. 9, 2004, in the Korean Intellectual Property Office, the disclosure of which is incorporated herein in its entirety by reference.

The present invention will now be described more fully with reference to the accompanying drawings, in which preferred embodiments of the invention are shown. The same elements are given the same reference numerals throughout the drawings.

Referring to FIGS. 3 through 6, a portable printing apparatus according to the present invention includes an outer case 110 and an inner case 120 each having a cylindrical shape, a paper path 140 formed between the outer case 110 and the inner case 120, a paper feed unit (172, 174) for feeding a sheet of paper P along the paper path 140, a printing unit (152,154) for printing an image on the sheet of paper P, and a rotating unit (164, 166) for rotating the printing unit.

The outer case 110 has a cylindrical inner surface, and may have a cylindrical exterior configuration or shape.

The inner case 120 is installed inside the cylindrical inner surface of the outer case 110, and has a cylindrical outer surface facing and spaced by a predetermined distance from the cylindrical inner surface of the outer case 110. The inner case 120 may have a cylindrical shape as well. A slot 124 having a predetermined width is formed running along a circumference of the inner case 120 to correspond to a traveling path of the printing unit. The slot 124 may be formed at a middle section (as measured along a longitudinal direction) of the cylindrical inner case 120.

The printing apparatus may further include a base 130 supporting the outer case 110 and the inner case 120. The base 130 is installed under the outer case 110 and provides stability and support to the outer case 110 and the inner case 120. A support portion 122 having a predetermined width is formed between the inner case 120 and the outer case 110 to support the inner case 120 relative to the outer case 110 so that a predetermined distance or gap is maintained between the cylindrical inner surface of the outer case 110 and the cylindrical outer surface of the inner case 120. The support portion 122 may be positioned on the base 130 or on a side opposite to the base 130 or may simply be an extension between the outer case 110 and the inner case 120. The support portion 122 may be in the form of a single, unitary configuration or comprise multiple units adjacent each other along the longitudinal direction of the outer case 110 and inner case 120.

Paper path 140 along which a sheet of paper P passes is formed between the cylindrical inner surface of the outer case 110 and the cylindrical outer surface of the inner case 120, i.e., within the predetermined distance between the cylindrical inner surface of the outer case 110 and the cylindrical outer surface of the inner case 120. Accordingly, the paper path 140 of the printing device of the present invention is a non-planar paper path, and in a preferred embodiment, the paper path 140 has a cylindrical configuration.

In the present embodiment, the length of the paper path 140 may be less than the length of the sheet of paper P, i.e., the longitudinal length of each of the outer case 110 and the inner case 120 is less than the length of the sheet of paper P. Moreover, the diameter of the inner surface of the outer case 110 is less than the width of the sheet of paper P.

The paper feed unit for feeding the sheet of paper P along the paper path 140 may include a plurality of paper feed rollers 172. The plurality of paper feed rollers 172 may be installed on an inner surface of the inner case 120 at predetermined intervals, and a plurality of roller driving motors 174 may also be installed on the inner surface of the inner case 120 for rotating the plurality of paper feed rollers 172. The plurality of paper feed rollers 172 may be disposed on both sides of the slot 124.

A plurality of through-holes 126 are formed in the inner case 120. The plurality of paper feed rollers 172 are inserted into the plurality of through-holes 126 such that a surface of each of the plurality of paper feed rollers 172 can contact the sheet of paper P passing along the paper path 140.

The paper feed unit may further include a plurality of idle rollers 176. The plurality of idle rollers 176 are installed on the inner surface of the outer case 110 to respectively correspond to and match the plurality of paper feed rollers 172. A plurality of grooves 116 into which the plurality of idle rollers 176 are respectively inserted to a predetermined depth may be formed in the inner surface of the outer case 110. The grooves 116 ensure that the distance between the inner surface of the outer case 110 and the outer surface of the inner case 120 is minimized and prevent it from having to be increased excessively to accommodate the idle rollers 176. Alternatively, the placement of the paper feed rollers 172 and associated plurality of roller driving motors 174 and the placement of the idle rollers 176 may be switched, depending on the preferred configuration.

In the printing apparatus of the present embodiment, in order to print an image at an exact position on the sheet of paper P, the sheet of paper P should be fed along the paper path 140 while maintaining close contact with a reference surface, i.e., the outer surface of the inner case 120. To this end, the printing apparatus of the present embodiment may further include a paper contacting unit that contacts the sheet of paper P fed along the paper path 140 onto the outer surface of the inner case 120. The paper contacting unit may include a plurality of leaf springs 180 that are installed on the inner surface of the outer case 110 in order to contact the sheet of paper P onto the outer surface of the inner case 120. In particular, the plurality of leaf springs 180 may be disposed on both sides of the slot 124 at predetermined intervals along a longitudinal direction of the slot 124 because an image is printed on the sheet of paper P within the slot 124 as it will be described later. Leaf springs 180 constitute but one example of the different types of paper contacting unit that may be employed in the printer of the present invention as other types of guides may be used.

The printing unit is installed inside the inner case 120, and prints an image on the sheet of paper P fed along the paper path 140 while rotating about a central axis 166 of the inner case 120, as will be described below.

The rotating unit is installed inside the inner case 120 and rotates the printing unit. The rotating unit may include a driving motor 164 for rotating the printing unit, and a support member 162 installed inside the inner case 120 to support the driving motor 164.

The printing unit may be an inkjet printing unit, a thermal printing unit, a piezo-electric printing unit, or another well-known printing unit. For example, when an inkjet printing unit is used, the printing unit may include an ink cartridge 152 rotatably mounted about the axis of rotation 166 of the driving motor 164. A print head 154 disposed on an end of the ink cartridge 152 ejects ink onto the sheet of paper P as the ink cartridge 152 is rotated about the central axis of rotation 166 by driving motor 164 to effect printing.

Figure 3:
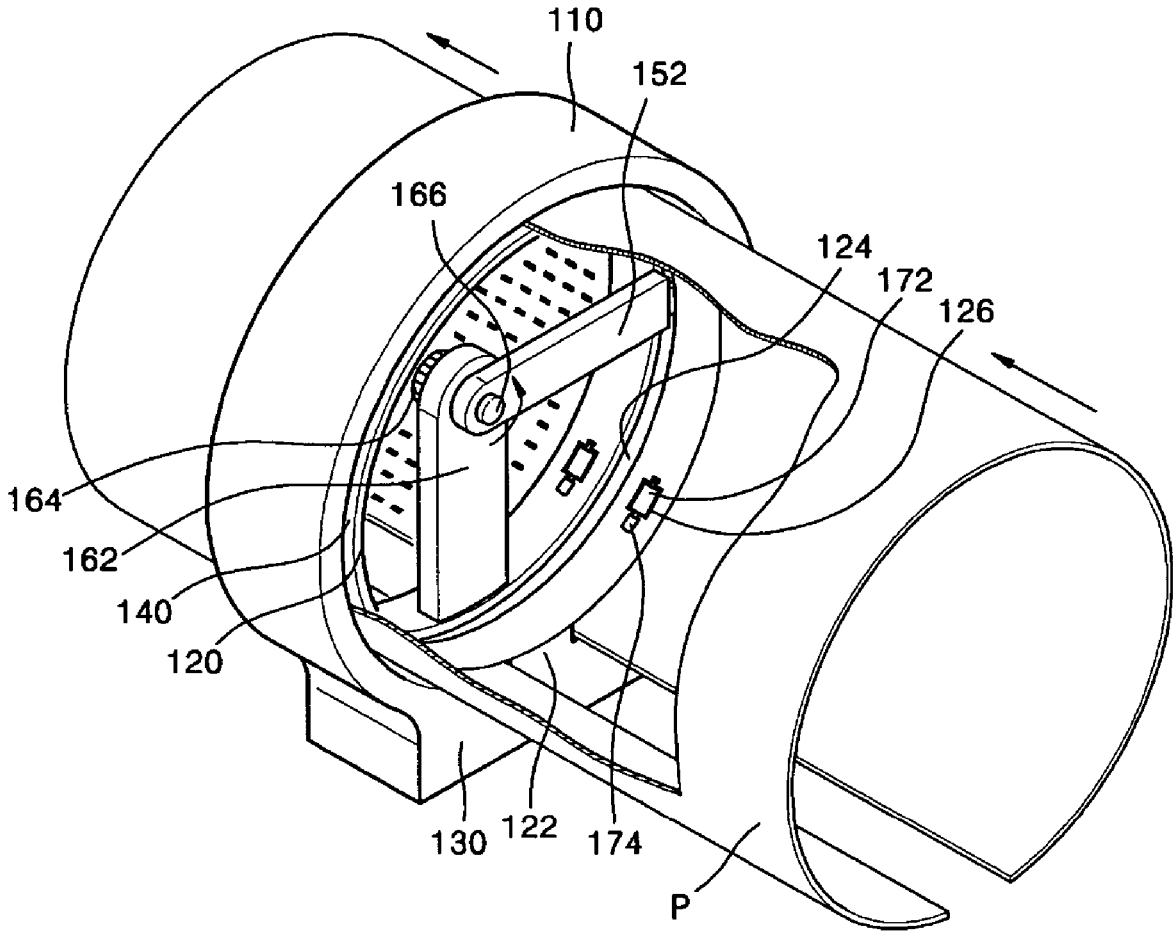
FIG. 3 is a perspective view of a portable printing apparatus according to an embodiment of the present invention.
Figure 4:
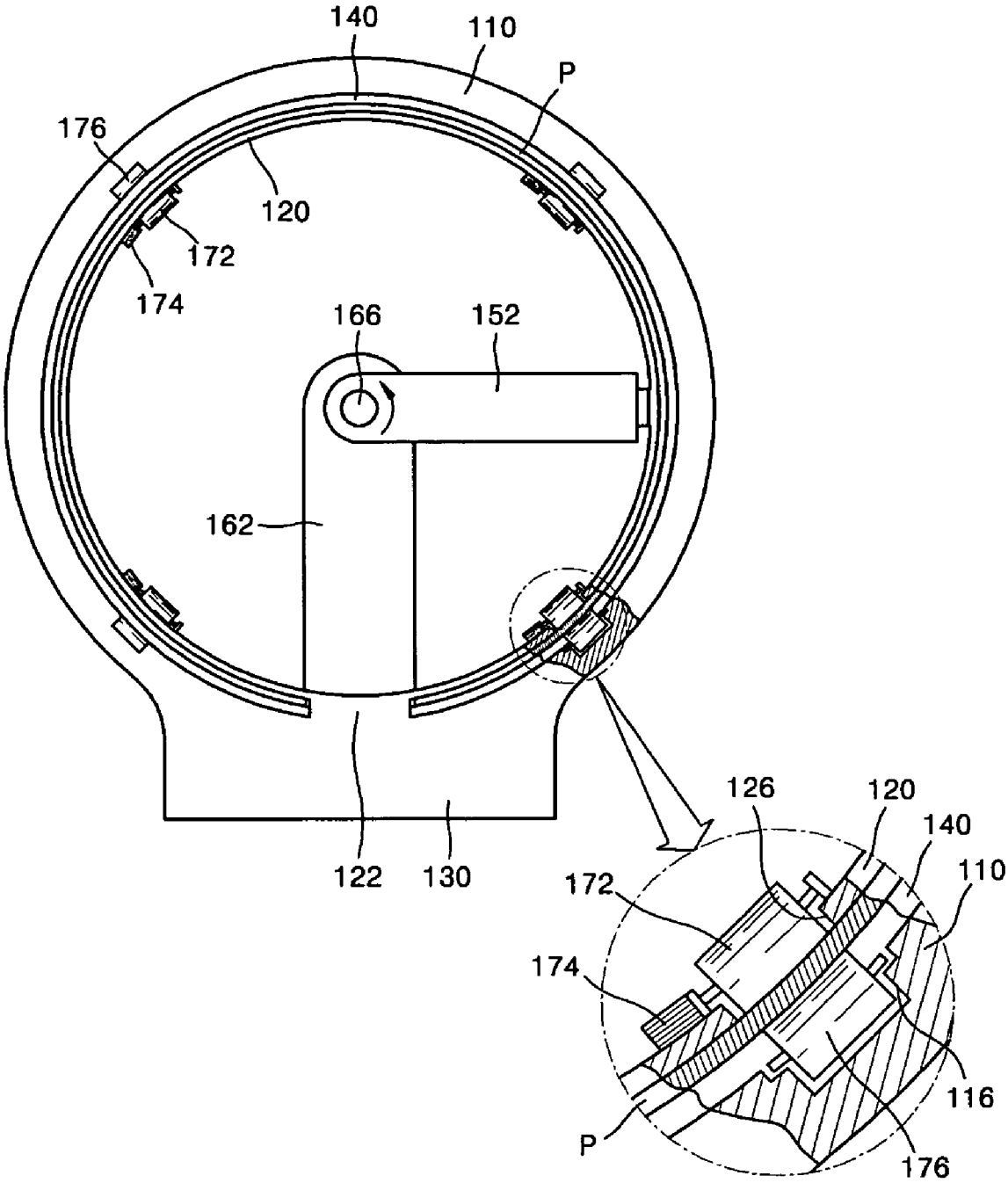
FIG. 4 is a front, elevational schematic view of the printing apparatus of FIG. 3.
Figure 5:
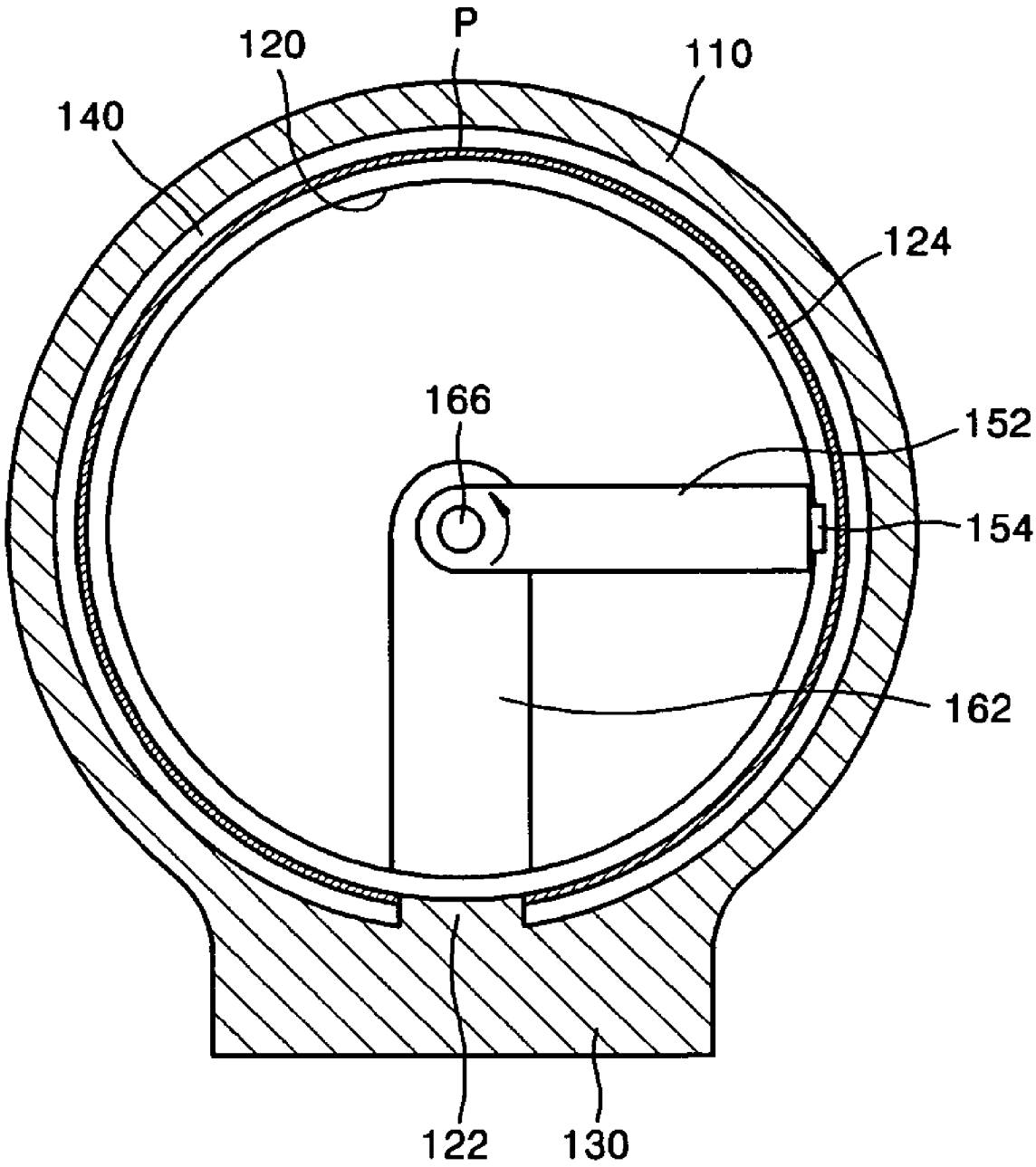
FIG. 5 is a front, elevational sectional view taken along a direction of a slot of the printing apparatus of FIG. 3.
Figure 6:
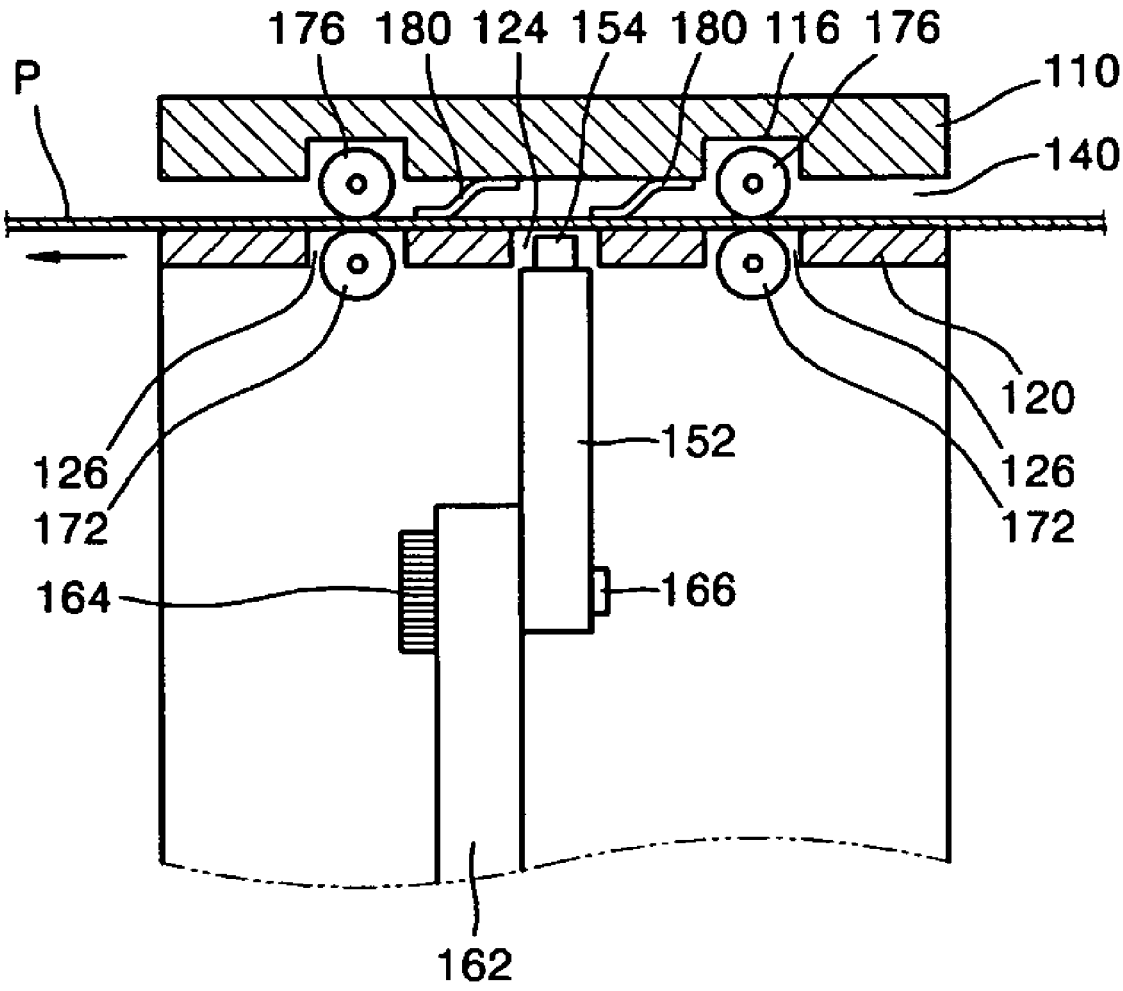
FIG. 6 is partial, sectional view taken along a longitudinal direction of the printing apparatus of FIG. 3.

Although only one ink cartridge 152 is shown in FIG. 3, a plurality of ink cartridges having a corresponding plurality of inkjet print heads may be used as the printing unit. In such a case, since the plurality of ink cartridges include a black ink cartridge and several color ink cartridges, a color image can be printed. Also, in the printing apparatus of the present embodiment, the ink cartridges and the print heads may be arranged in an array pattern. When a plurality of ink cartridges are used or when they are especially arranged in an array pattern, the width of the slot 124 formed in the inner case 120 is varied to accommodate the plurality of ink cartridges and may be greater than the width depicted in FIGS. 3 through 6.

A thermal printing unit may include a head support unit rotating about the axis of rotation 166 of the driving motor 166, and a thermal head mounted on an end of the head support unit and printing an image on the sheet of paper P using thermal transfer technology. In this case, the head support unit may be substituted for the ink cartridge 152, and the thermal head may be substituted for the print head 154.

A printing operation of the printing apparatus of FIG. 3 constructed as above will now be described.

First, a front end of the sheet of paper P is inserted through the paper path 140, which is formed between the inner surface of the outer case 110 and the outer surface of the inner case 120, until the front end of the sheet of paper P reaches the paper feed rollers 172. When a print command is input to the printing apparatus, the paper feed rollers 172 rotate to pick up and feed the sheet of paper P. At this time, the sheet of paper P is fed while being maintained in close contact with the outer surface of the inner case 120 by the leaf springs 180.

After the sheet of paper P reaches the slot 124, the ink cartridge 152 rotates and ejects ink from the print head 154 to print an image on the sheet of paper P. A line of image data is printed on the sheet of paper P during one revolution of the ink cartridge 152. If the ink cartridges 152 or the print heads 154 are arranged in an array pattern as described above, a plurality of lines of image data can be printed on the sheet of paper P during one revolution of the ink cartridges 152.

When one revolution of the ink cartridge 152 is completed and while the print head 154 passes through a portion where the sheet of paper P does not exist, i.e., while the print head 154 passes through the support portion 122, the sheet of paper P is advanced or moved by the paper feed roller 172 by a predetermined distance. The ink cartridge 152 continues to rotate, and the sheet of paper P, having been stopped after advancing a predetermined distance, is printed with a next line of image data by the print head 154.

As the process is repeatedly performed, a desired image is printed on the sheet of paper P, and the printed sheet of paper P is continuously fed by the paper feed rollers 172 and the idle rollers 176 and is finally discharged to the outside of the printing apparatus.

As described above, according to the printing apparatus of the present embodiment, since the print head 154 rotates continuously without stopping to print an image on the sheet of paper P, print speed can be markedly enhanced as compared with the conventional art. In addition, since the dimensions of each of the outer case 110 and the inner case 120, i.e., diameters, are less than the length or width of the sheet of paper P being printed, the printing apparatus of the present invention can be made significantly smaller than the dimensions of the sheet of paper P. Thus, true compactness and portability while providing high print throughput can be realized by the printing apparatus of the present invention.

Printing apparatuses according to other embodiments of the present invention will now be explained herein below.

Figure 7:
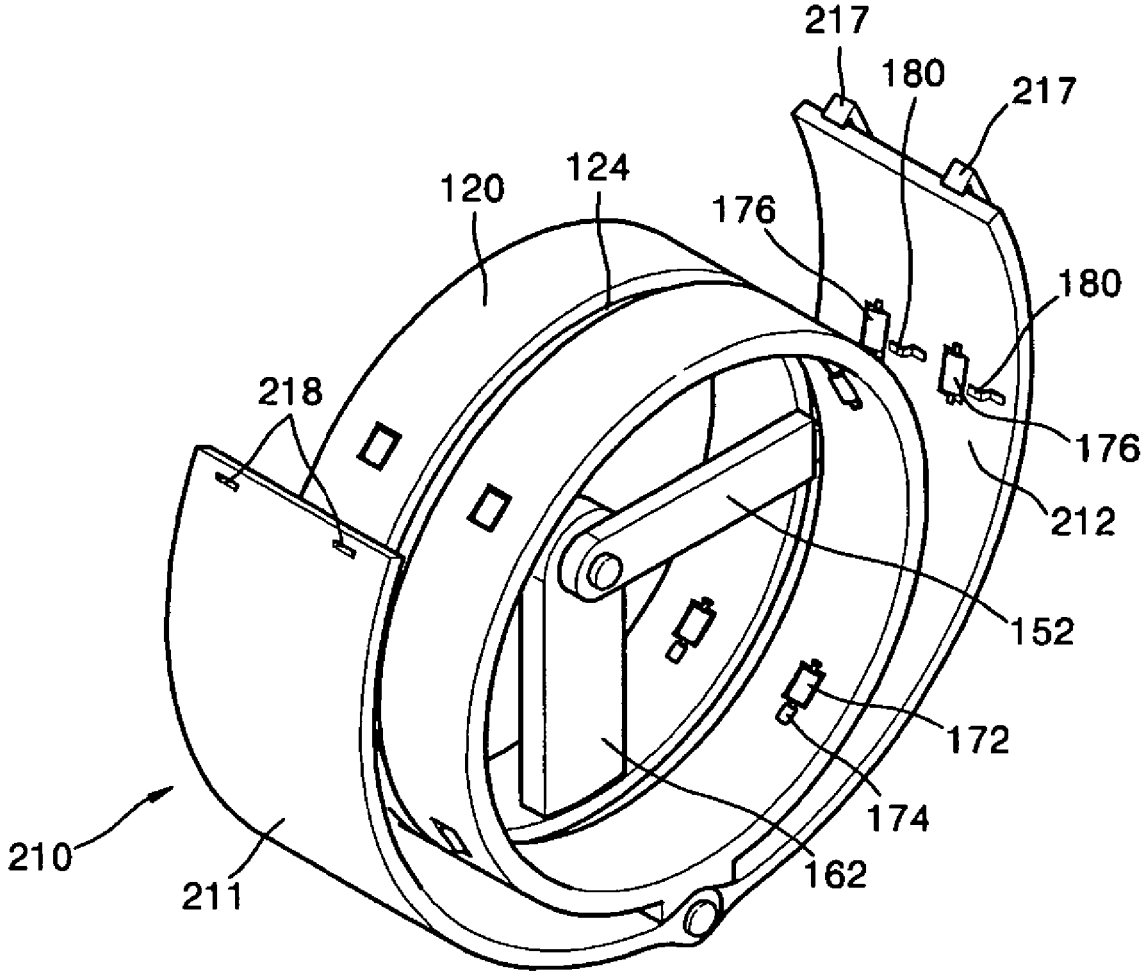
FIG. 7 is a perspective view of a portable printing apparatus according to another embodiment of the present invention.

Referring to FIG. 7, a perspective view of a portable printing apparatus according to another embodiment of the present invention is shown. The printing apparatus of FIG. 7 is the same as the printing apparatus illustrated in FIGS. 3 through 6, except for the structure or configuration of an outer case. The outer case 210 has a cylindrical shape, and can be opened and closed. Specifically, the outer case 210 is divided into semi-cylindrical first portion 211 and second portion 212. First ends of the first portion 211 and the second portion 212 are hinge-coupled, and an opening unit is disposed on second ends of the first and second portions 211 and 212. The opening unit includes at least one hook 217 disposed on the second end of the second portion 212, and at least one groove 218 formed in the second end of the first portion 211 so that the hook 217 can engage and be held in the groove 218.

The opening unit may have other well-known structure other than the hook 217 and the groove 218, e.g., latching mechanism, any suitable locking mechanism, etc. The opening unit of the outer case 210 may be used in the printing apparatus having the base 130 shown in FIG. 3. In this case, first ends of the first portion 211 and the second portion 212 of the outer case 210 are hinge-coupled to the base 130.

In a printing device according to the present invention, if the outer case 210 has the opening unit, any sheet of paper P can be easily inserted into the paper path 140, and in instances when a paper jam occurs, the sheet of paper P can be easily removed from the printing apparatus by opening the opening unit of the outer case 210. Moreover, the printing apparatus can be more easily disassembled and repaired when the opening unit is used in the outer case 210.

Figure 8:
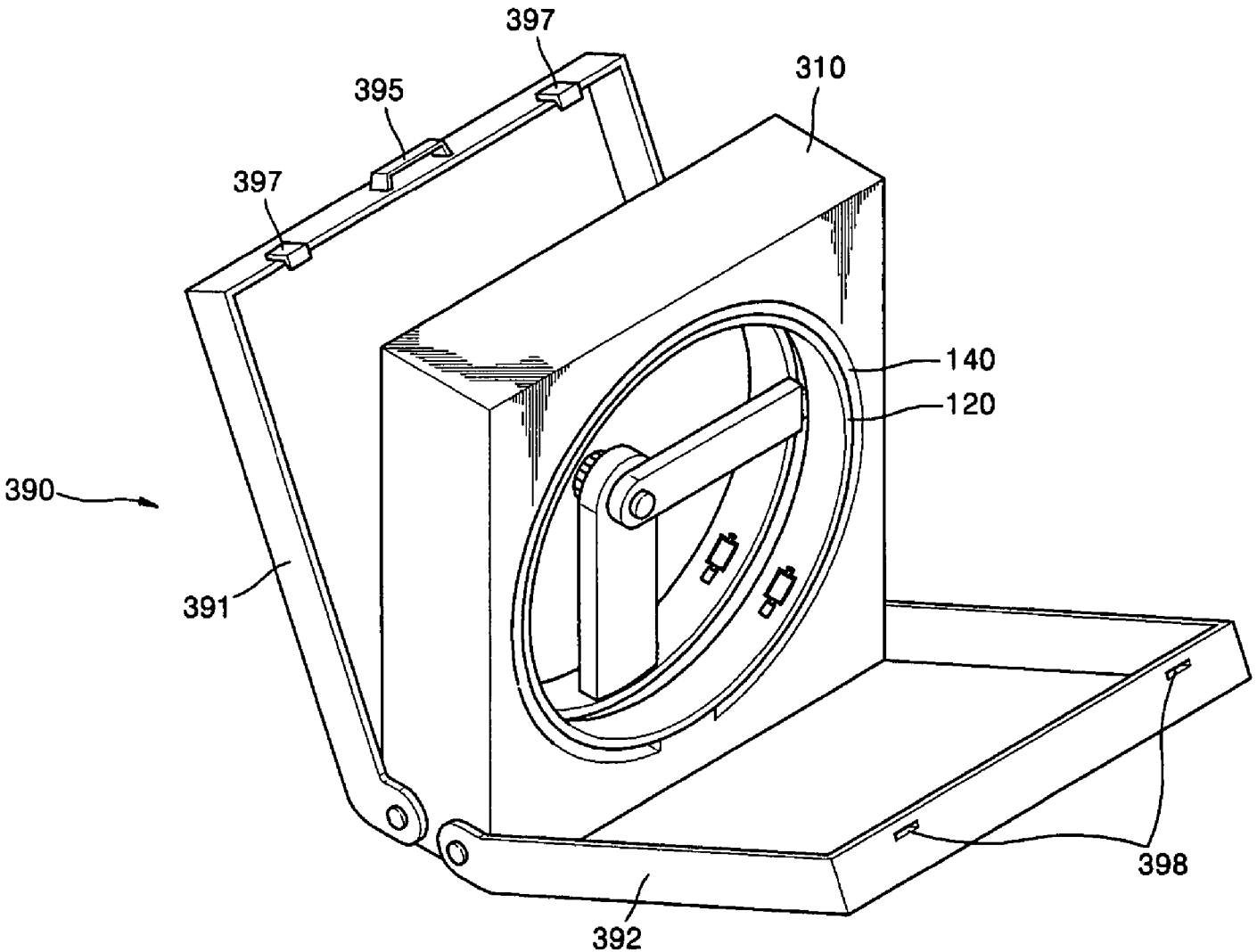
FIG. 8 is a perspective view of a portable printing apparatus according to still another embodiment of the present invention.

Referring to FIG. 8, a perspective view of a portable printing apparatus according to still another embodiment of the present invention is shown. The portable printing apparatus of FIG. 8 is the same as the printing apparatus of FIGS. 3 through 6, except a protective case is further provided, as will be explained below.

Referring to FIG. 8, an outer case 310 may have a square outer shape. However, the outer case 310 has a cylindrical inner surface as shown in the previous embodiments.

As described above, the printing apparatus according to the present invention may have a cylindrical shape as described in the previous embodiments or a square outer shape as in the present embodiment illustrated in FIG. 8 or any other outer shape. Accordingly, the degree of design freedom for the printing apparatus of the present invention is unlimited and provides a wide range of design possibilities for a printing apparatus.

The printing apparatus of the present embodiment illustrated in FIG. 8 may further include a protective case 390 surrounding and protecting the outer case 310 and the inner case 120 and the paper path 140 formed therebetween. The protective case 390 may have a shape corresponding to the outer case 310. That is, when the outer case 310 has a square outer shape as shown in FIG. 8, the protective case 390 may also have a square shape. When the outer case has a cylindrical shape as shown in the previous embodiments illustrated in FIGS. 3 through 7, the protective case 390 may have a cylindrical shape or a square shape, depending on design preference.

The protective case 390 can be opened and closed. To this end, the protective case 390 is divided into a first protective case portion 391 and a second protective case portion 392. First ends of the first protective case portion 391 and the second protective case portion 392 are hinge-coupled to the outer case 310, and an opening unit is disposed on second ends of the first and second protective case portions 391 and 392. The opening unit includes at least one hook 397 disposed on the second end of the first protective case portion 391, and at least one groove 398 formed in the second end of the second protective case portion 392 so that the hook 397 can engage and be held in the groove 398. The opening unit may have other well-known structure other than the hook 397 and the groove 398 described, e.g., latching mechanism, any suitable locking mechanism, etc.

A handle 395 may be disposed on the protective case 390, and thereby further enhance the portability of the printing apparatus of the present invention.

The protective case 390 can protect the printing apparatus from external physical dangers such as physical shock as well as environmental elements such as dust, moisture and radiation. Also, if the two protective case portions 391 and 392 of the protective case 390 are opened and spread out to be horizontal, the outer case 310 and the inner case 120 can be more stably supported during a printing operation.

To illustrate the compactness of the printer apparatus of the present invention, if the circumference of the paper path 140 and support portion 122 equaled 8½ inches plus ½ inch for a total of 9 inches, the diameter from the 3 o'clock position to the 9 o'clock position, i.e., 180 degrees, of the paper path would be calculated by using the formula, $d=C/\pi$, where d is the diameter, C is the circumference, and $\pi$ is given the approximation of 3.14159, as follows:

$$d=9 \text{ inches}/3.14159 \text{ or } 2.8648 \text{ inches.}$$

If the thickness of the outer case 110 is given an allowance of ⅛ inch, then the entirety of the printer would have a width no bigger than 2.8648+2(0.125)=3.1148 inches. Accordingly, the entire printer would have approximate dimensions of 3⅛ inch wide×3.5 inch height×1 inch depth and be able to print standard letter, legal and A4 size paper.

As described above, since the printing apparatus of the present invention prints an image on the sheet of paper P by continuous rotation of the print head without stopping to change direction, a significant and dramatic increase in print speed can be achieved as compared to the conventional art.

Furthermore, since the physical dimensions of the inventive printing apparatus can be less than both the length and width of the sheet of paper P being printed, the printing apparatus provides true compactness and portability with greater print speed without sacrificing print quality.

Moreover, the printing apparatus can be designed to have a square or cylindrical or any other exterior configuration. Accordingly, the exterior configuration of the printer could be made to allow for customization by the user.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A printing apparatus comprising:

an outer case having a cylindrical inner surface;

an inner case installed inside the outer case and having a cylindrical outer surface facing and spaced by a predetermined distance from the cylindrical inner surface of the outer case;

a paper path formed between the cylindrical inner surface of the outer case and the cylindrical outer surface of the inner case;

a paper feed unit for feeding a sheet of paper along the paper path;

a printing unit rotatably mounted about a central axis of the inner case; and a rotating unit operatively associated with the printing unit to rotate the printing unit about the central axis of the inner case.

2. The printing apparatus as claimed in claim 1, wherein:

the cylindrical outer surface of the inner case has a circumference that is greater than a width of the sheet of paper, the paper is guided through the paper path such that a leading edge of the paper corresponding to the width direction of the paper is generally in a plane of the rotating unit and a length direction of the paper is generally parallel to an axis of rotation of the rotating unit, and the length of each of the outer case and the inner case is less than the length of the sheet of paper.

3. The printing apparatus as claimed in claim 2, wherein:

the circumference of the cylindrical outer surface of the inner case is in contact with the sheet of papers, a circumferential slot is defined in the inner case, the circumferential slot defining a plane parallel to a plane defined by rotation of the rotating printing unit, and the slot exposes the paper to the rotating printing unit.

4. The printing apparatus as claimed in claim 1, wherein the outer case has a cylindrical outer shape.

5. The printing apparatus as claimed in claim 1, wherein the outer case has a square outer shape.

6. The printing apparatus as claimed in claim 1, wherein the outer case may be opened or closed.

7. The printing apparatus as claimed in claim 6, wherein the outer case comprises two portions, each portion having first ends hinge-connected to each other and second ends on which an opening unit is disposed.

8. The printing apparatus as claimed in claim 7, wherein the opening unit includes a hook disposed on the second end of one of the two portions of the outer case, and a groove formed in the second end of the other one of the two portions in order to allow the hook to engage and be held in the groove.

9. The printing apparatus as claimed in claim 1, wherein the inner case has a slot having a predetermined width formed therein along a path of the printing unit.

10. The printing apparatus as claimed in claim 1, wherein:

the printing unit includes at least one print head rotatably mounted on the rotating unit and configured to eject ink onto the sheet of paper to print an image, and the ejected ink traverses a circumferential opening defined through a wall of the inner case to reach the sheet of paper.

11. The printing apparatus as claimed in claim 10, wherein the printing unit is supplied with ink from a plurality of ink cartridges.

12. The printing apparatus as claimed in claim 1, wherein:

the printing unit includes a head support unit rotatably mounted on the rotating unit and having a thermal head that prints an image on the sheet of paper, and the inner case has a circumferential opening defined through a wall thereof, the opening exposing the sheet of paper to the thermal print head.

13. The printing apparatus as claimed in claim 1, wherein the paper feed unit includes a plurality of paper feed rollers rotatably mounted on the inner case, and a roller driving motor operatively engaged with each paper feed roller to rotate each paper feed roller.

14. The printing apparatus as claimed in claim 13, wherein the inner case has a plurality of through-holes through which a surface of each of the plurality of paper feed rollers contacts the sheet of paper passing along the paper path.

15. The printing apparatus as claimed in claim 13, wherein the paper feed unit further includes a plurality of idle rollers mounted on the inner surface of the outer case to respectively correspond to the plurality of paper feed rollers.

16. The printing apparatus as claimed in claim 15, wherein the inner surface of the outer case has a plurality of grooves into which the plurality of paper feed rollers are respectively inserted to a predetermined depth.

17. The printing apparatus as claimed in claim 1, further comprising a paper contacting unit for contacting the sheet of paper onto the outer surface of the inner case.

18. The printing apparatus as claimed in claim 17, wherein the paper contacting unit includes a plurality of leaf springs mounted on the inner surface of the outer case.

19. The printing apparatus as claimed in claim 1, wherein:

the paper is guided through the paper path such that a leading edge of the paper corresponding to a width direction of the paper is generally in a plane of the rotating unit and a length direction of the paper is generally parallel to an axis of rotation of the rotating unit, the rotating unit includes a driving motor for rotating the printing unit, and a support member on the inner case to support the driving motor, the sheet of paper is wrapped around the inner case such that two side edges of the paper are juxtaposed and separated by a predetermined gap, and the support member extends from the inner case to the outer case through the gap.

20. The printing apparatus as claimed in claim 1, further comprising a base supporting the outer case and the inner case.

21. The printing apparatus as claimed in claim 1, further comprising a protective case surrounding and protecting the outer case and the inner case.

22. The printing apparatus as claimed in claim 21, wherein the protective case has a shape corresponding to the outer case.

23. The printing apparatus as claimed in claim 21, wherein the protective case may be opened and closed.

24. The printing apparatus as claimed in claim 23, wherein the protective case is divided into two portions which have first ends hinge-connected to the outer case and second ends on which an opening unit is disposed.

25. The printing apparatus as claimed in claim 24, wherein the opening unit includes a hook disposed on the second end of one of the two portions of the protective case, and a groove formed in the second end of the other one of the two portions in order to allow the hook to engage and be held in the groove.

26. The printing apparatus as claimed in claim 21, wherein the protective case has a handle.

27. The printing apparatus as claimed in claim 1, wherein the paper path is non-planar.

28. The printing apparatus as claimed in claim 1, wherein the paper path is cylindrical.

* * * * *